US007715765B2

(12) United States Patent
Ichikawa et al.

(10) Patent No.: US 7,715,765 B2
(45) Date of Patent: May 11, 2010

(54) DETACHABLE CARTRIDGE AND IMAGE FORMING APPARATUS

(75) Inventors: Hideo Ichikawa, Kanagawa (JP); Naoto Nishi, Kanagawa (JP); Ryuji Hattori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 201 days.

(21) Appl. No.: 11/808,215

(22) Filed: Jun. 7, 2007

(65) Prior Publication Data

US 2007/0286646 A1 Dec. 13, 2007

(30) Foreign Application Priority Data

Jun. 8, 2006 (JP) ..... P2006-160162

(51) Int. Cl.
*G03G 15/08* (2006.01)

(52) U.S. Cl. ..... 399/258; 399/260; 399/262

(58) Field of Classification Search ..... 399/111, 399/119, 258, 260, 262
See application file for complete search history.

(56) References Cited

U.S. PATENT DOCUMENTS 4,967,234 A * 10/1990 Tani et al. ..... 399/13
4,977,429 A * 12/1990 Tani et al. ..... 399/27
5,019,861 A 5/1991 Surti ..... 355/200
5,061,958 A * 10/1991 Bunker et al. ..... 399/81
5,550,617 A * 8/1996 Odagawa et al. ..... 399/176
6,795,660 B2 * 9/2004 Yugeta et al. ..... 399/27
7,054,591 B1 * 5/2006 Wilhelm et al. ..... 399/360
2004/0052538 A1 3/2004 Yugeta et al. ..... 399/27
2005/0214046 A1 * 9/2005 Stickler et al. ..... 399/358
2006/0182469 A1 * 8/2006 Koyama et al. ..... 399/258
2006/0204276 A1 * 9/2006 Takuwa ..... 399/110
2007/0269236 A1 * 11/2007 Takuwa ..... 399/258
2008/0075483 A1 * 3/2008 Bito et al. ..... 399/35
2009/0148188 A1 * 6/2009 Iino ..... 399/231

FOREIGN PATENT DOCUMENTS

CN 1484110 A 3/2004
CN 03103673.2 3/2004
JP 11-295972 10/1999
JP 2005-134452 5/2005

* cited by examiner

*Primary Examiner*—David M Gray
*Assistant Examiner*—G. M. Hyder
(74) *Attorney, Agent, or Firm*—Morgan, Lewis & Bockius LLP

(57) ABSTRACT

A detachable cartridge includes: a buffer portion that contacts with a contacted portion when the detachable cartridge is attached to an image forming apparatus body, the contacted portion being provided on the image forming apparatus body, and that buffers impact, the detachable cartridge being detachable from the image forming apparatus body during an image recording operation of recording an image on a recording sheet.

10 Claims, 11 Drawing Sheets

DETACHABLE CARTRIDGE AND IMAGE FORMING APPARATUS

CROSS-REFERENCE TO RELATED APPLICATIONS

This application is based on and claims priority under 35 U.S.C. 119 from Japanese Patent Application No. 2006-160162 filed Jun. 8, 2006.

BACKGROUND

1. Technical Field

The present invention relates to a detachable cartridge detachably attached to an image forming apparatus body, and also relates to image forming apparatuses, to and from each of which the detachable cartridge is attached and detached, such as a printer, a FAX, a copying machine, and a complex machine having functions of all of the printer, the FAX, and the copying machine or having a plurality of such functions. More particularly, the invention relates to a detachable cartridge that is attachable to and is detachable from an image forming apparatus body during an image forming operation of an image forming apparatus, and also relates to an image forming apparatus to and from of which the detachable cartridge is attached and detached.

The detachable cartridge includes, for example, a developer cartridge (or a toner cartridge), a waste toner cartridge, a paper tray unused during an image forming operation, and a process cartridge unused in an image forming operation (for example, a process cartridge into which developing units and associated photoreceptors other than those corresponding to black used during a monochromatic printing operation in a color image forming unit are united).

SUMMARY

According to an aspect of the present invention, a detachable cartridge includes: a buffer portion that contacts with a contacted portion when the detachable cartridge is attached to an image forming apparatus body, the contacted portion being provided on the image forming apparatus body, and that buffers impact, the detachable cartridge being detachable from the image forming apparatus body during an image recording operation of recording an image on a recording sheet.

BRIEF DESCRIPTION OF THE DRAWINGS

Exemplary embodiment of the present invention will be described in detail based on the following figures, wherein:

FIG. 9A is a bottom view illustrating a cartridge body. FIG. 9B is a cross-sectional view taken on line IXB-IXB. FIG. 9C is a cross-sectional view taken on line IXC-IXC. FIG. 9D is a cross-sectional view taken on line IXD-IXD;

FIG. 11A is an explanatory view illustrating a state in which a buffer portion is not engaged with an engaged portion therefore yet. FIG. 11B is an explanatory view illustrating a state in which the buffer portion is engaged with the engaged portion therefore. FIG. 11C is an explanatory view illustrating a state in which the attachment of the toner cartridge is completed.

DETAILED DESCRIPTION

Figure 1:
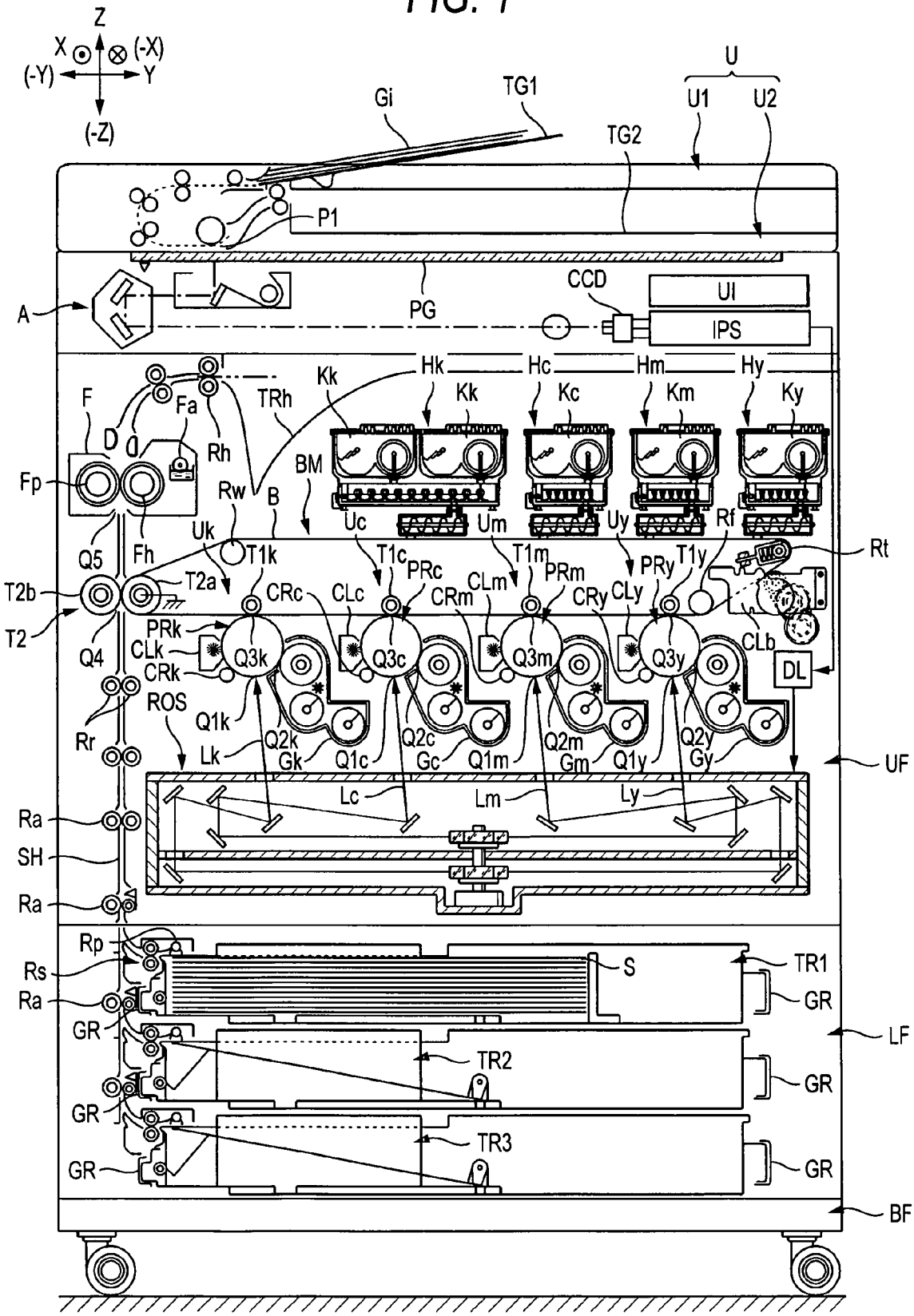
FIG. 1 is an explanatory view illustrating an image forming apparatus according to a first embodiment of the invention.

Hereinafter, practical examples (or embodiments) of the invention are described below by referring to the accompanying drawings. However, the invention is not limited to the following embodiments.

Additionally, to facilitate understanding of the following description, in the drawings, an X-direction represents an anteroposterior direction, a Y-direction represents a lateral direction, and a Z-direction represents an up-down direction. The directions represented by arrows X, (−X), Y, (−Y), Z, and (−Z) are a frontward direction, a backward direction, a rightward direction, a leftward direction, an upward direction, and a downward direction, respectively. Also, the side indicated by the arrows X, (−X), Y, (−Y), Z, and (−Z) are a frontward side, a backward side, a rightward side, a leftward side, an upward side, and a downward side, respectively.

Additionally, in the drawings, a white circle with a central dot "•" represents an arrow directed from the back surface of paper, on which an associated drawing is drawn, to the front surface thereof. A white circle with a central cross mark represents an arrow directed to the back surface of paper, on which an associated drawing is drawn, from the front surface thereof.

Incidentally, in the following description described by referring to the drawings, the drawing of members other than those necessary for facilitating understanding is appropriately omitted.

First Embodiment

FIG. 1 is an explanatory view illustrating an image forming apparatus according to a first embodiment of the invention.

As shown in FIG. 1, the image forming apparatus U has an automatic original conveying unit U1, and an image forming apparatus body (a copying apparatus) U2 which supports the automatic original conveying unit U1 and has a platen glass PG at the top thereof.

The automatic original conveying unit U1 has an original feed tray TG1, on which originals Gi to be copied are stacked, and also has an original discharge tray TG2 from which the originals Gi conveyed from the original feed tray TG1 through a copying position (an original reading position) P1 on the platen glass PG are discharged.

The image forming apparatus body U2 includes a UI (user interface) used by users to input operating command signals, such as a copy start signal, and an exposure optical system A.

Reflection light reflected from an original, which is conveyed to the original reading position P1 on the platen glass PG by the automatic original conveying unit U2, or which is manually put on the platen glass PG, is converted by a CCD (or a solid-state image sensor) through the exposure optical system A into electrical signals respectively corresponding to R (red), G (green), and B (blue).

An IPS (image processing system) converts electrical signals respectively corresponding to the R, G, and B into image data respectively corresponding to K (black), Y (yellow), M (magenta), and C (cyan). Then, the IPS temporarily stores the image data. Subsequently, the IPS outputs the image data to laser drive circuits DL with predetermined timing as those for forming an electric latent image.

Incidentally, in a case where an original image is monochrome, only image data corresponding to K (black) is input to the laser drive circuits DL including laser drive circuits (not shown) respectively to the colors Y, M, C, and K. The laser drive circuits DL output laser drive signals, which respectively correspond to the input image data, to image writing laser diodes (not shown) of a latent image forming optical system (or an electrostatic latent image forming apparatus) ROS, which respectively correspond to the colors.

Toner image forming units Uy, Um, and Uc disposed above the ROS form electrostatic latent images respectively having colors Y (yellow), M (magenta), C (cyan), and K (black).

Laser beams Ly, Lm, Lc, and Lk respectively corresponding to the colors Y, M, C, and K output from the laser diodes of the latent image forming optical system (ROS) are incident upon rotating-photoreceptors (image carriers) Pry, PRm, PRc, and PRk.

The toner image forming unit Uy corresponding to the color Y has the rotating photoreceptor Pry, a charging roll CRy serving as a charging device, a developing unit Gy, a transfer roll (transfer device) T1*y*, and a cleaner CLy. Each of the toner image forming units Um, Uc, and Uk is configured similarly to Each of the photoreceptors PRy, PRm, PRc, and PRk is uniformly electrified by an associated one of the charging rolls CRy, CRm, CRc, and CRk. Subsequently, electrostatic latent images are formed on the surfaces of the photoreceptors PRy, PRm, PRc, and PRk at image writing positions (latent image forming positions) Q1*y*, Q1*m*, Q1*c*, and Q1*k* by the laser beams Ly, Lm, Lc, and Lk. The electrostatic latent images formed on the surfaces of the photoreceptors PRy, PRm, PRc, and PRk are developed into toner images by the developing devices Gy, Gm, Gc, and Gk in developing areas, respectively.

The developed toner images are conveyed to primary transfer areas Q3*y*, Q3*m*, Q3*c*, and Q3*k* contacting with an intermediate transfer belt (a transfer member; an intermediate transfer body; and an image carrier) B, respectively. In primary transfer areas Q3*y*, Q3*m*, Q3*c*, and Q3*k*, a primary transfer voltage having a polarity opposite to the electrification polarity of the toner is applied with predetermined timing from a power supply circuit E, which is controlled by a controller C, to each of primary transfer rolls T1*y*, T1*m*, T1*c*, and T1*k* disposed on the rear surface of the intermediate transfer belt B.

The toner images formed on the photoreceptors PRy to PRk are primarily transferred onto the intermediate transfer belt B by the primary transfer rolls T1*y*, T1*m*, T1*c*, and T1*k*. Residual toner remaining on the surface of each of the surfaces PRy, PRm, PRc, and PRk is cleaned by an associated one of the photoreceptor cleaners CLy, CLm, CLc, and CLk, after the primary transfer.

A belt module BM enabled to be move in an up-down direction and to be frontwardly moved is disposed above the photoreceptors PRy to PRk. The belt module BM has the intermediate transfer belt B, and the belt support rolls (Rt, Rw, Rf, T2*a*) including a tension roll Rt, a walking roll Rw, an idler roll (or free roll) Rf, and a backup roll T2*a* that serves also as a drive roll, and also includes the primary transfer rolls T1*y*, T1*m*, T1*c*, and T1*k*, and a belt cleaner (or intermediate transfer cleaner) CLb. Additionally, the intermediate transfer belt B is supported by the belt support roll (Rt, Rw, Rf, T2*a*) to be able to rotationally move.

A secondary transfer roll T2*b* is disposed to face the surface of the intermediate transfer belt B contacting with the backup roll T2*a*. A secondary transfer device T2 includes the rolls T2*a* and T2*b*. A secondary transfer area Q4 is formed in a region in which the secondary transfer roll T2*b* faces the intermediate transfer belt B.

Color toner images transferred by being serially superimposed on the transfer devices T1*y*, T1*m*, T1*c*, and T1*k* in the primary transfer areas Q3*y*, Q3*m*, Q3*c*, and Q3*k* are conveyed to the secondary transfer area Q4.

Three stages, each of which includes a pair of left and right guide rails GR, GR supports the paper feed trays TR1 to TR3 under the ROS so that the paper feed trays TR1 to TR3 can move in and out in the anteroposterior direction (the X-direction). Recording sheets (transfer materials) S are taken out of the paper feed trays TR1 to TR3 by a pickup roll Rp and are separated one by one by a separation roll Rs. Then, the recording sheets S are sent one by one to a registration roll Rr by a plurality of conveying rolls Ra. A plurality of the sheet conveying rolls Ra are disposed along a sheet conveying path SH formed of a sheet guide. A sheet conveying unit (SH+Ra+Rr) includes the sheet conveying path SH, the sheet conveying roll Ra, and the registration roll Rr.

The conveyance of the recording sheet S by the registration roll Rr to the secondary transfer area Q4 is performed by being timed to the conveyance of color toner images formed on the intermediate transfer belt B to the secondary transfer area Q4. When the recording sheet S passes through the secondary transfer area Q4, the backup roll T2*a* is grounded. A secondary transfer voltage having a polarity opposite to the electrification polarity of the toner is applied to the secondary transfer roll T2*b* with predetermined timing from the power supply circuit E controlled by the controller C. At that time, the color toner images formed on the intermediate transfer belt B are transferred onto the recording sheet S by the secondary transfer device T2.

The intermediate transfer belt B is cleaned by the belt cleaner CLb after the secondary transfer.

The recording sheet S, onto which the toner image is transferred, is conveyed to a fixing area Q5 serving as a pressure-contact area in which a heating roll Fh of a fixing unit F is press-contacted with a heating roll Fp. After the recording sheet S is conveyed from the discharge roller Rh to the discharge tray TRh after the recording sheet S is heat-fixed when passing through the fixing area Q5.

Incidentally, the surface of the heating roll Fh is coated with a demolding agent, which is used to enhance the releasability of sheet S from the heating roll by a releasing-agent coating unit Fa.

As shown in FIG. 1, the image forming unit U has an upper frame UF and a lower frame LF. The ROS and members (the photoreceptors PRy, PRm, PRc, and PRk, the developing device Gy, Gm, Gc, and Gk, and the belt module BM and soon) disposed above the ROS are supported in the upper frame UF.

Also, the guide rails GR supporting the paper feed trays TR1 to TR3, and the paper feed members (the pickup roll Rp, the separation roll Rs, the sheet conveying roll Ra, and so on) adapted to feed paper from the trays TR1 to TR3 are supported in the lower frame LF.

(Toner Replenishing Unit)

Figure 2:
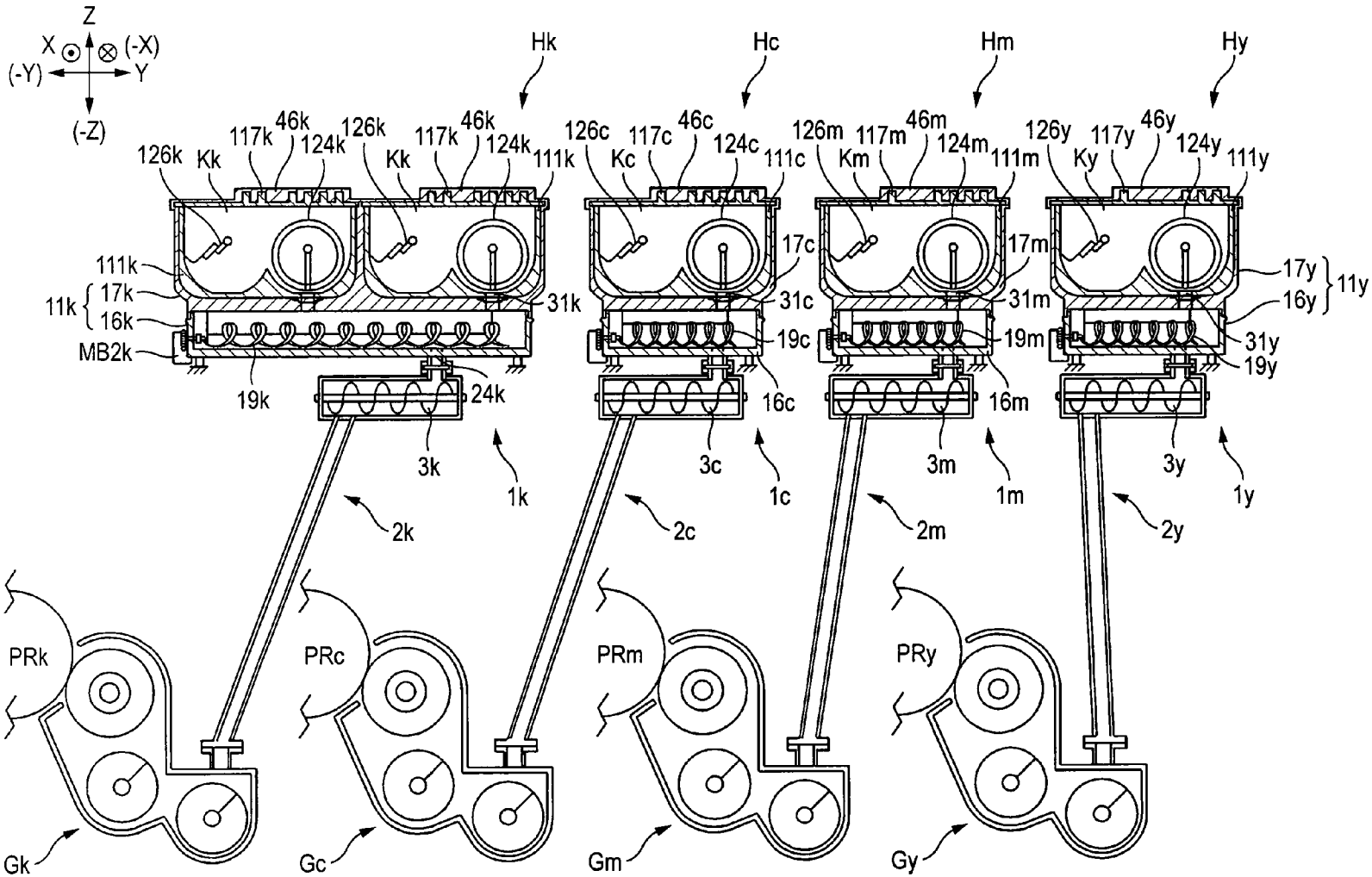
FIG. 2 is an explanatory cross-sectional view illustrating a primary part of each toner replenishing unit of the first embodiment.

FIG. 2 is an explanatory cross-sectional view illustrating a primary part of each toner replenishing unit of the first embodiment.

As shown in FIG. 1, toner replenishing units Hy, Hm, Hc, and Hk respectively corresponding to the colors Y (yellow), M (magenta), C (cyan), and K (black) are disposed above the belt module BM. As shown in FIG. 2, each of the toner replenishing units Hy to Hk has a corresponding one of toner cartridges Ky to Kk, a corresponding one of replenishing unit bodies 1*y* to 1*k* to which the corresponding toner cartridge is attached, a corresponding one of the toner conveying paths 2*y* to 2*k*, which connects a corresponding one of the developing devices Gy to Gk to the corresponding one of the replenishing unit bodies 1*y* to 1*k*, and a corresponding one of toner conveying members 3*y* to 3*k*, which is disposed in the corresponding one of the toner conveying paths 2*y* to 2*k* and is adapted to convey the corresponding one of the replenishing unit bodies 1*y* to 1*k* to the corresponding one of the developing units Gy to Gk.

Figure 3:
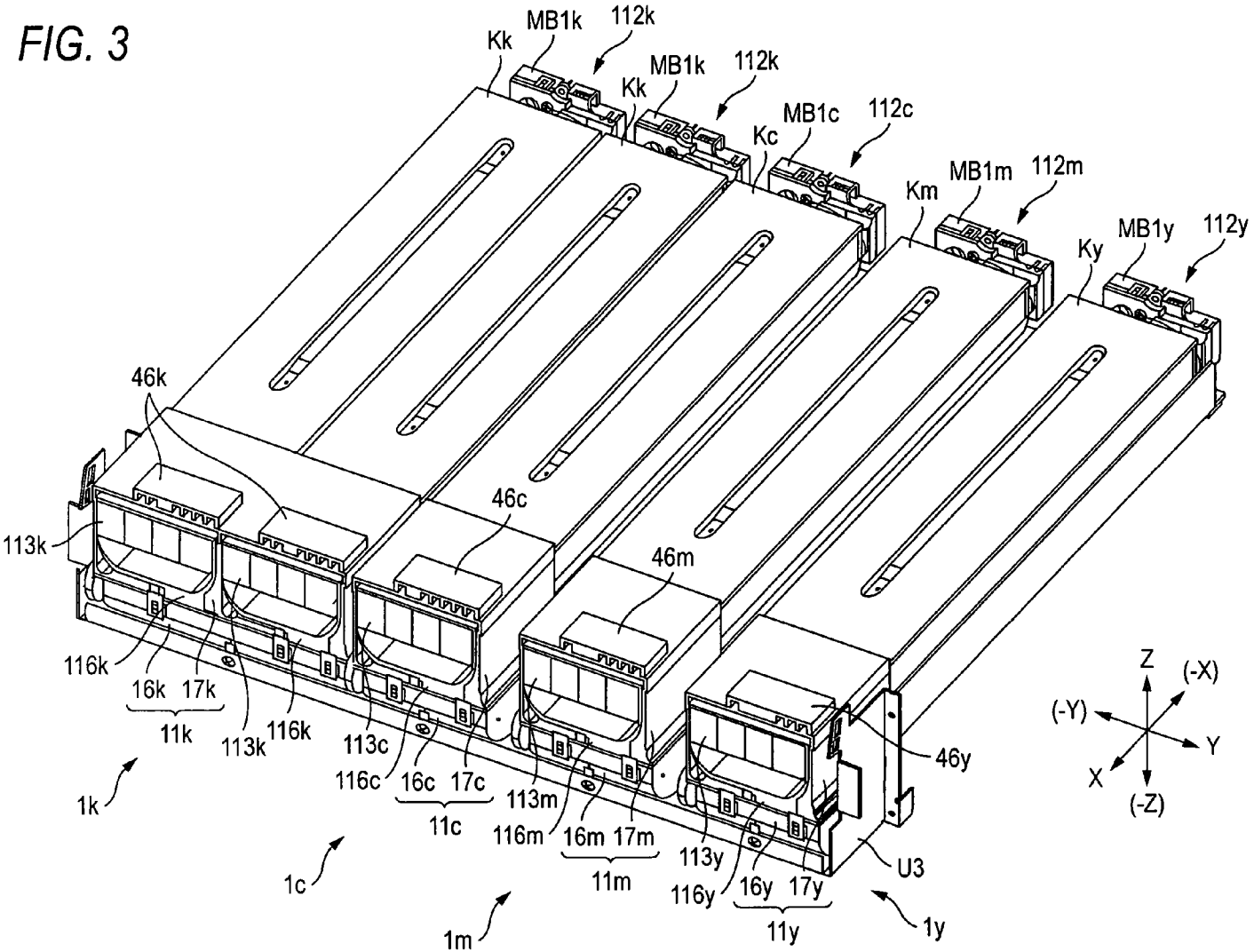
FIG. 3 is a perspective view illustrating the toner replenishing unit of the first embodiment.

FIG. 3 is a perspective view illustrating the toner replenishing unit of the first embodiment.

Figure 4:
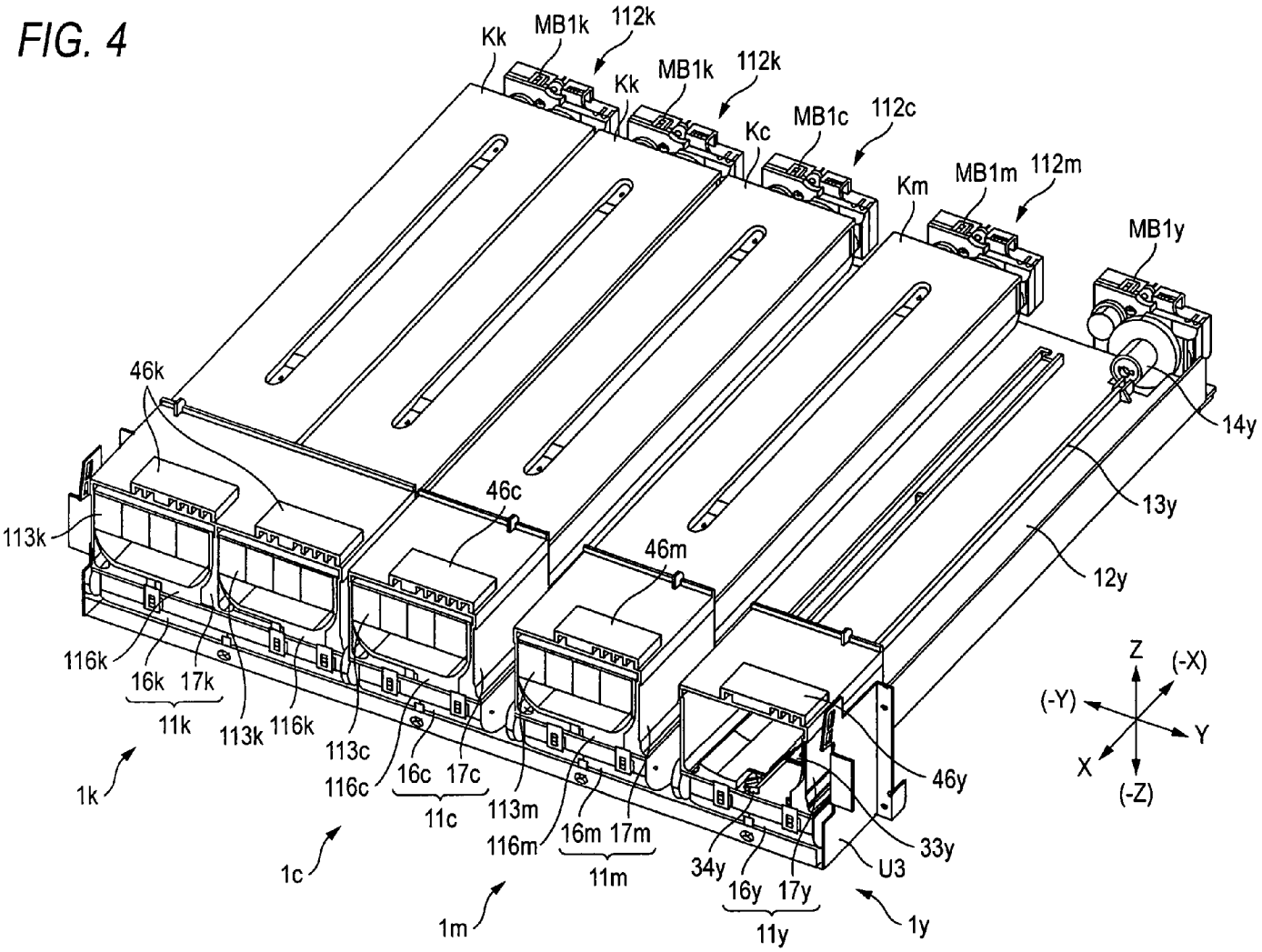
FIG. 4 is a perspective view illustrating a state in which a toner cartridge corresponding to a Y-color is detached from the toner replenishing unit of the first embodiment.

FIG. 4 is a perspective view illustrating a state in which a toner cartridge corresponding to a Y-color is detached from the toner replenishing unit of the first embodiment.

Figure 5:
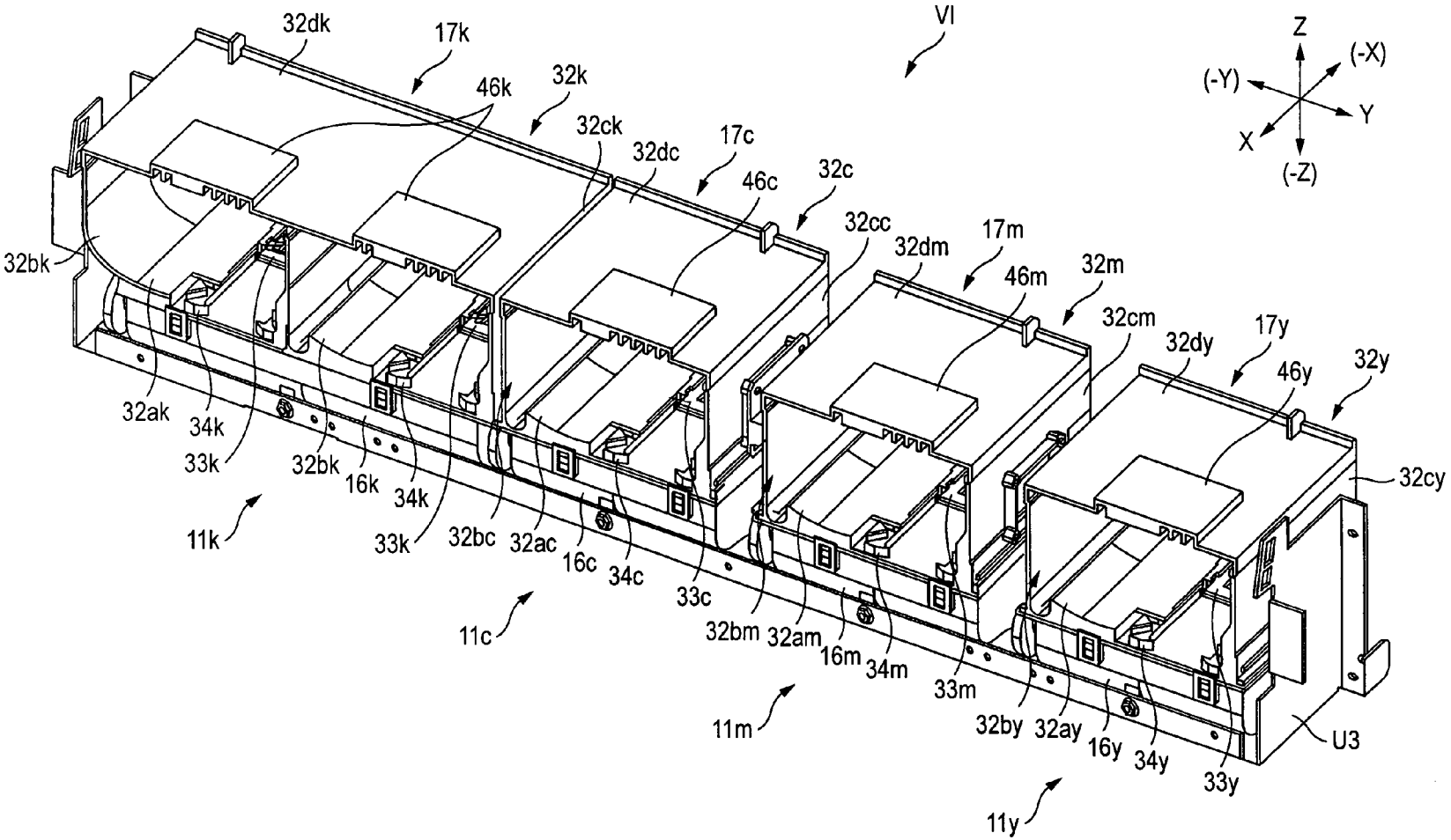
FIG. 5 is an enlarged perspective view illustrating a cartridge front-end support member.

FIG. 5 is an enlarged perspective view illustrating a cartridge front-end support member.

Figure 6:
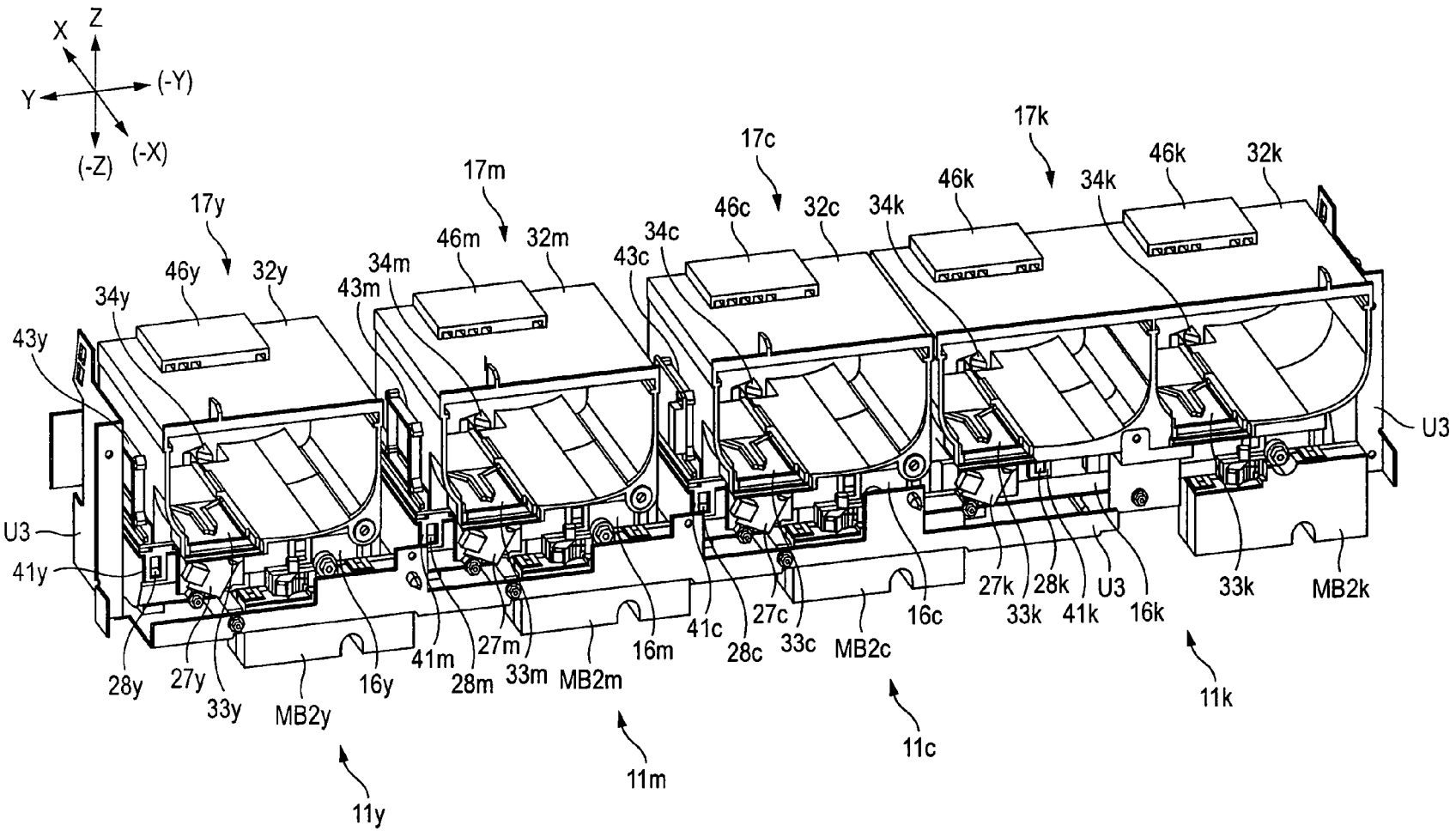
FIG. 6 is a view taken from the direction of an arrow VI shown in FIG. 5.

FIG. 6 is a view taken from the direction of an arrow VI shown in FIG. 5.

As shown in FIGS. 3 and 4, each of the replenishing unit bodies 1*y* to 1*k* has a corresponding one of cartridge front-end support members 11*y* adapted to support the front end portion (the rear end portion in an insertion direction) of a corresponding toner cartridge Ky when the cartridge is attached thereto, and also has a corresponding cartridge body support member 12*y* (see FIG. 4) configured to the body of the attached toner cartridge Ky. As shown in FIGS. 3 to 6, the cartridge front-end support members 11*y* to 11*k* are integrally fixed to and supported by a replenishing unit support frame U3. Cartridge body support members 12*y* to 12*k* are fixed to and supported by the image forming apparatus body U2. The replenishing unit body 1*k* corresponding to K (black) is configured so that two toner cartridges containing toner corresponding to K (black), which is frequently used, can be attached thereto. Each of other replenishing unit bodies 1*y*, 1*m*, and 1*c* respectively corresponding to Y (yellow), M (magenta), and C (cyan) is configured to be able to contain a single of a corresponding one of toner cartridges Ky, Km, and Kc respectively corresponding to Y (yellow), M (magenta), and C (cyan).

Next, each member of the replenishing unit bodies 1*y* to 1*k* are described below in detail. The replenishing unit bodies 1*y*, 1*m*, and 1*c* respectively corresponding to Y (yellow), M (magenta), and C (cyan) are configured similarly to one another. The replenishing unit body 1*k* corresponding to K (black) has a configuration, in which two replenishing unit bodies, each of which is similar to the replenishing unit body corresponding to Y (yellow), are connected to each other, so that two toner cartridges Kk can be attached thereto. Thus, the configuration of the replenishing unit body 1*y* corresponding to the color Y is described below in detail by adding character "y" to the end of each reference numeral. The detailed description of the replenishing unit bodies 1*m* to 1*k* respectively corresponding to the other colors is omitted herein.

Incidentally, the image forming unit U of the first embodiment uses two toner cartridges corresponding to the color K which is frequently used. Thus, toner is replenished from one of the toner cartridges. When the one of the toner cartridges becomes empty, a developer is replenished from the other toner cartridge. Because such a technique has hitherto be known (see, for example, JP-A-2004-109367), the detailed description of such a technique is omitted herein.

As shown in FIG. 4, the cartridge body support member 12*y* has a guide rail 13*y* adapted to guide the toner cartridge Ky to be attached thereto and detached therefrom, and also has a cartridge motor box MB1*y* configured to transmit a driving force to the attached toner cartridge Ky. When the toner cartridge Ky is attached to the cartridge body support member 12*y*, the cartridge body support member 12*y* engages with a gear (to be described later) of a toner cartridge rear end (a front end in the insertion direction) to transmit the driving force.

As shown in FIGS. 5 and 6, the cartridge front-end support member 11*y* corresponding to each color includes a reserve tank 16*y*, which temporarily stores toner supplied from the toner cartridge Ky, and also includes a replenishing port formation member 17*y* that closes the top surface of the reserve tank 16*y* and that has a toner replenishing port 31*y* (see FIG. 2) formed therein, through which toner supplied from the front end portion of the toner cartridge Ky passes. As shown in FIG. 2, an agitation conveying member 19*y* configured to perform the circulation conveyance of the developer stored in the reserve tank 16*y* while agitating the developer, and to discharge the developer to the replenishing unit body 1*y* is disposed in the reserve tank 16*y*.

Incidentally, the configurations of the reserve tank 16*y* and the members disposed therein have hitherto been known (see, for example, JP-A-2005-134452). Thus, the detailed description of the reserve tank 16*y* and the members disposed therein is omitted herein.

As shown in FIGS. 5 and 6, the replenishing port formation member 17*y* has a replenishing port formation member body 32*y* that supports the front end portion of the toner cartridge Ky and that has a toner replenishing port 31*y* formed therein, through which toner supplied from the toner cartridge Ky passes. Also, the replenishing port formation member 17*y* has a replenishing port shutter 33*y* adapted to close and open the toner replenishing port 31*y*, and further has a shutter support member 34*y* that supports the replenishing port shutter 33*y* so that the shutter 33*y* can perform slide-movement. The replenishing port member body 32*y* has a bottom wall portion 32*ay*, in which the toner replenishing port 31*y* is formed, and left and right side wall portions 32*by* and 32*cy*, and a top wall portion (a contacted portion for the buffer portion) 32*dy*. An erroneous attachment preventing portion 46*y* is formed in the top surface of the top wall portion 32*dy*. The erroneous attachment preventing portion 46*y* is configured so that the toner cartridges Ky can be inserted into an inner part of the replenishing port formation member body 32*y* only in a case where the positions of holes (erroneous attachment preventing holes) formed in the erroneous attachment preventing portion 46*y* coincide with those of erroneous attachment preventing projection portions (to be described later) formed on the toner cartridge Kk, and where the number of the erroneous attachment preventing holes formed in the erroneous attachment preventing portion 46*y* is equal to the number of the erroneous attachment preventing projection portions formed on the toner cartridge Kk. Otherwise, the erroneous attachment preventing projection portions hooks in the replenishing port formation member body 32*y* and can be inserted to a middle part thereof. This prevents a user from erroneously attaching one of the toner cartridges Kc to Kk, which corresponds to an erroneous color to the body 32*y*.

Incidentally, the configurations of the replenishing port shutter 33*y* and the shutter support member 34*y* have hitherto been known (see, for example, JP-A-2005-134452). Thus, the detailed description of the replenishing port shutter 33*y* and the shutter support member 34*y* is omitted herein.

(Description of Toner Cartridge)

Next, the toner cartridge is described below. The toner cartridges respectively corresponding to the colors Y, M, C, and K are configured similarly to one another. Thus, only the toner cartridge corresponding to the color Y is described below in detail by adding character "y" to the end of each reference numeral. The detailed description of the toner cartridges Km to Kk respectively corresponding to the other colors is omitted herein.

Figure 7:
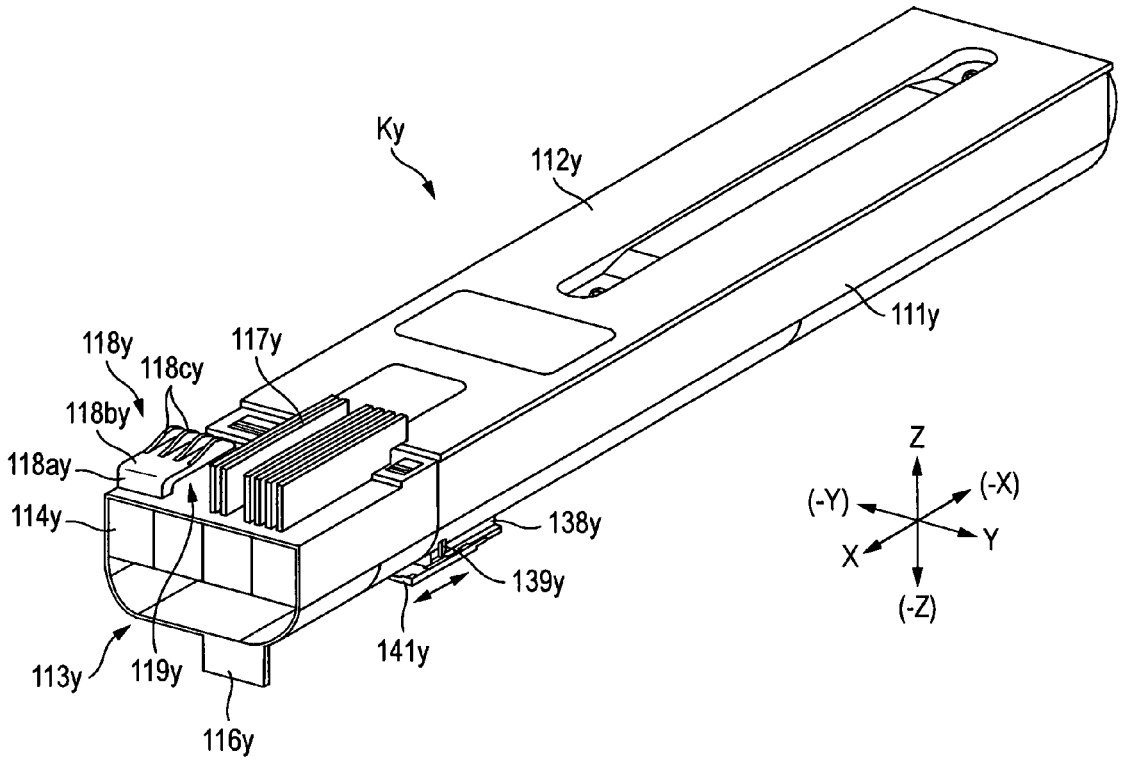
FIG. 7 is an explanatory perspective view illustrating the toner cartridge.

FIG. 7 is an explanatory perspective view illustrating the toner cartridge.

As shown in FIG. 7, the toner cartridge (or detachable cartridge) Ky corresponding to the color Y has a toner accommodating container (developer container) 111*y* accommodating the toner of the color Y, a cartridge cover 112*y* configured to cover the top surface of the toner accommodating container 111*y*, and a handle member (or handle portion) 113*y* attached at the front portion of the toner accommodating container 111*y*. The handle member 113*y* has a handle part 114*y*, which is used by a user to hold the toner cartridge Kk by hand, and a stopper portion 116*y* adapted to abut against the replenishing port formation member body 32*y* against the front end portion of the replenishing port formation member body 32*y* when the toner cartridge Ky is attached to the replenishing port formation member body 32*y*, to thereby prevent a user from inserting the toner cartridge Ky too much.

Also, the toner cartridge Ky has erroneous attachment preventing projection portions 117*y* formed on the top surface of the handle member 113*y* corresponding to the erroneous attachment preventing holes 46*ay* of the replenishing port formation member body 32*y*. Therefore, the toner cartridge Ky can be attached to the replenishing port formation member body 32*y* only in a case where the positions of the erroneous attachment preventing projection portions 117*y* coincide with those of the holes formed in the erroneous attachment preventing portion 46*y*, and where the number of the erroneous attachment preventing projection portions 117*y* is equal to that of the erroneous attachment preventing holes formed in the erroneous attachment preventing portion 46*y*, that is, a case where the colors of the toners respectively contained in the toner cartridges Ky to Kk are matched with those of toners respectively replenished to the developing devices Gy to Gk from the toner replenishing units Hy to Hk. Consequently, the toner cartridges Ky to Kk corresponding to wrong colors are prevented from being erroneously attached to the toner replenishing units Hy to Hk.

The buffer portion 118*y* is provided at a side part of the erroneous attachment preventing projection portion 117*y* provided on the top surface of the handle member 114*y*. The buffer portion 113*y* is formed integrally with the handle member 113*y*. The buffer portion 113*y* has a base portion 118*ay* formed integrally with the top surface of the handle member 113*y*, a buffer portion body 118*by* extending rearwardly from the base portion 118*ay*, and a upwardly-convex comb-like guide portion 118*cy* that is formed at a rear end portion (or free end portion) of the buffer portion body 118*by*. Consequently, an elastic deformation allowable space 119*y* is formed between the buffer portion body 118*by* and the top surface of the handle member 113*y*. Incidentally, the handle member 113*y* of the first embodiment is formed of a resin. The buffer portion 118*y* is elastically deformably constructed.

Figure 8:
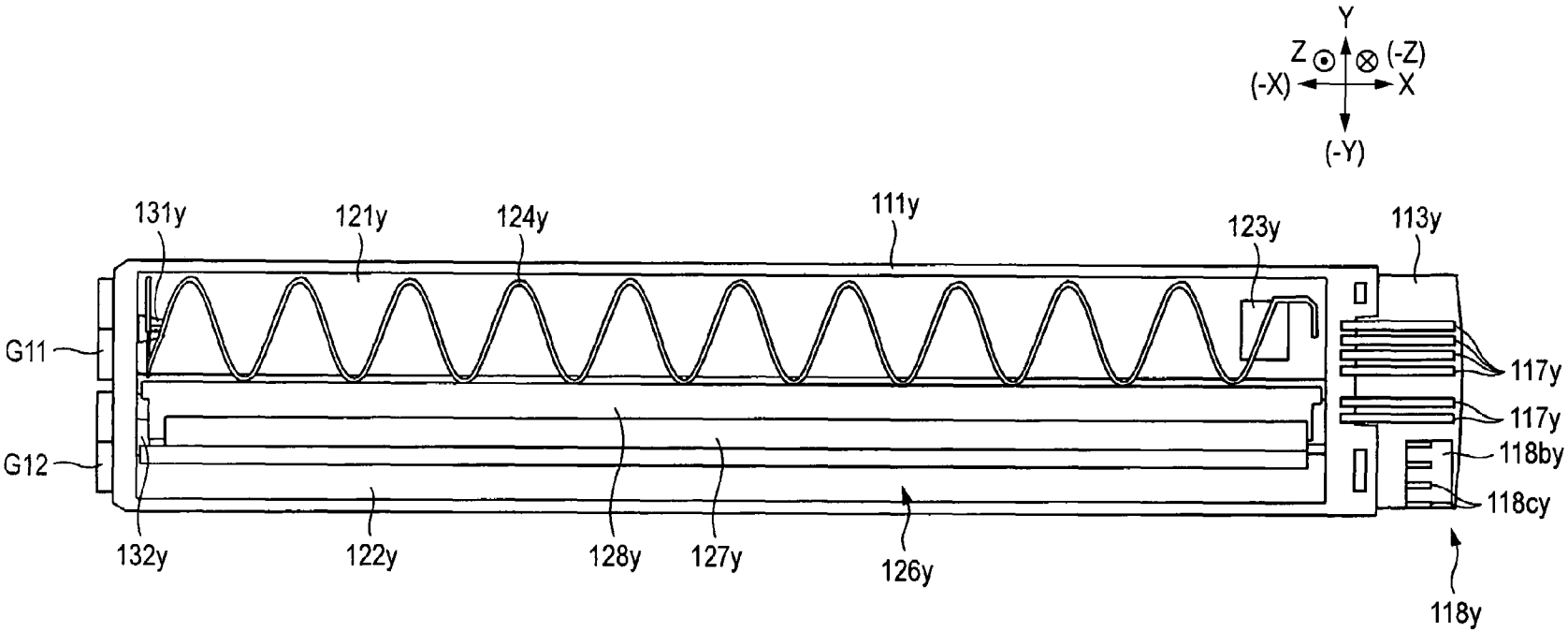
FIG. 8 is a plan view illustrating a state in which a cover is detached from the toner cartridge.

FIG. 8 is a plan view illustrating a state in which the cover is detached from the toner cartridge.

Figure 9A:
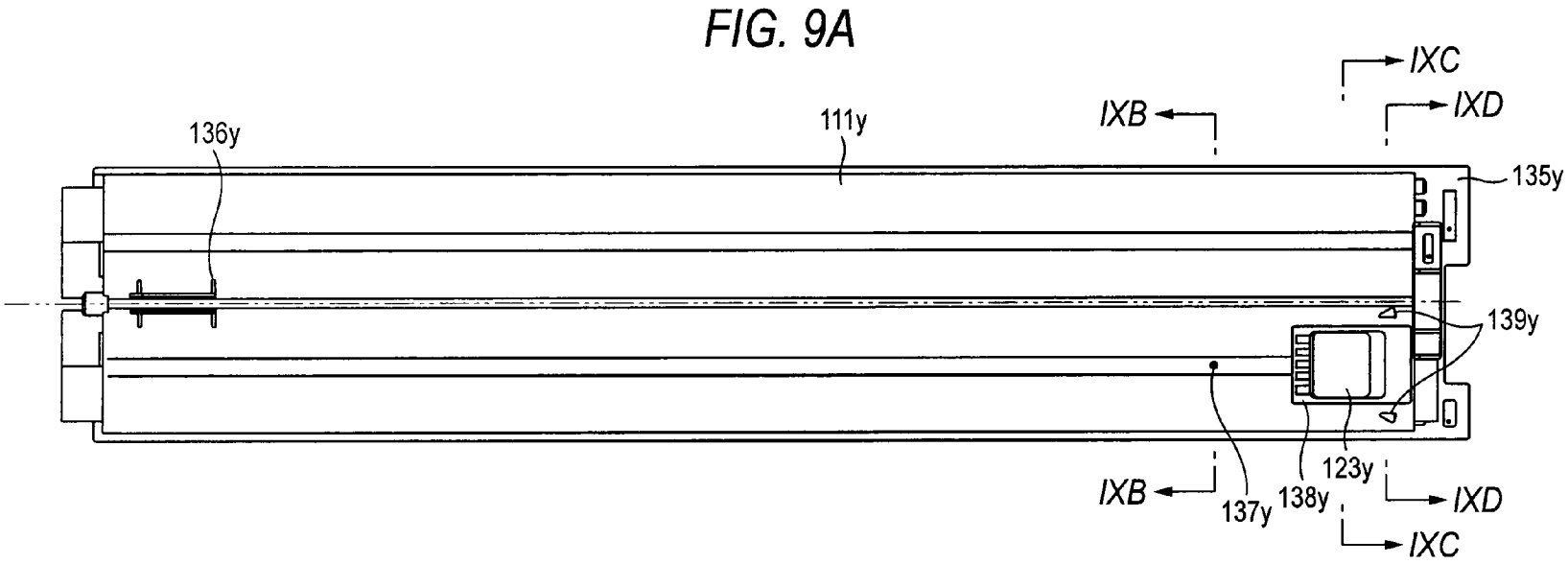
FIGS. 9A to 9D are explanatory views illustrating a state in which a cartridge shutter and the cover are detached from the toner cartridge.
Figure 9D:
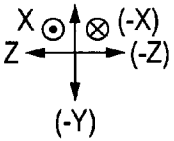
Figure 9D:
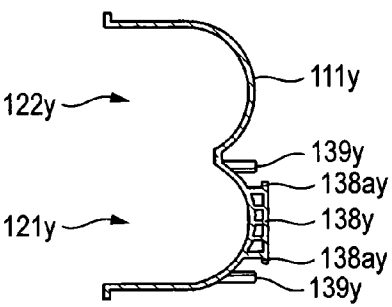
Figure 9C:
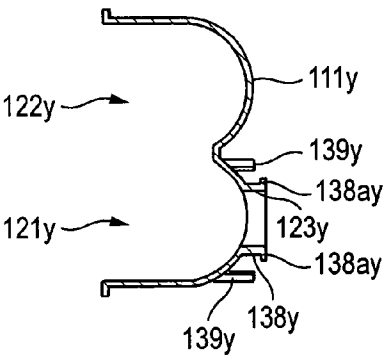
Figure 9B:
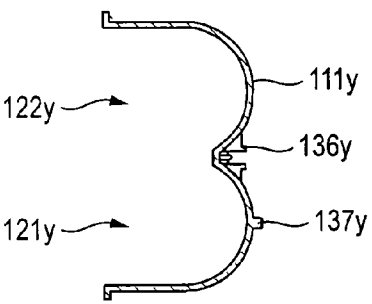

FIGS. 9A to 9D are explanatory views illustrating a state in which a cartridge shutter and the cover are detached from the toner cartridge. FIG. 9A is a bottom view illustrating a cartridge body. FIG. 9B is a cross-sectional view taken on line IXB-IXB. FIG. 9C is a cross-sectional view taken on line IXC-IXC. FIG. 9D is a cross-sectional view taken on line IXD-IXD.

As shown in FIGS. 8, and 9B to 9D, the toner accommodating container 111*y* has a right-side (+Y-side) first accommodating portion 121*y* and a left-side (−Y-side) second accommodating portion 122*y*. A toner supply port 123*y*, from which toner is discharged and is supplied to the reserve tank 16*y*, is formed in the front end part (+X-end part) of the first accommodating portion 121*y*.

As shown in FIG. 8, a spiral cartridge auger 124*y* configured to convey the toner accommodated in the first accommodating portion 121*y* to the toner supply port 123*y* is disposed in the first accommodating portion 121*y*. A conveying paddle 126*y* configured to convey the toner accommodated in the second accommodating portion 122*y* to the first accommodating portion 121*y* is disposed in the second accommodating portion 122*y*. The conveying paddle 126*y* has a film support plate 127*y*, which is fixed to a rotating shaft, and a toner conveying film 128*y* fixed to the film support plate 127*y*. The toner conveying film 128*y* is elastically deformably constituted, and scoops the toner accommodated in the second accommodating portion 122*y* and conveys the toner to the first accommodating portion 121*y*.

The rear end (−X-end, that is, the front end in the direction in which the cartridge is inserted) of the cartridge auger 124*y* is fixed to and supported by an auger support member 131*y* rotatably supported on the rear end wall of the toner accommodating container 111*y*. The rear end of the conveying paddle 126*y* is fixed to and supported by a rotatable paddle support member 132*y*. Then, gears G11 and G12 (see FIGS. 8 and 9A) are fixed to the rear ends of the auger support member 131*y* and the paddle support member 132*y*, respectively. The gears G11 and G12 mesh with the driving force transmitting gear 14*y* when the toner cartridge Ky is attached to the toner replenishing unit body 1*y*. Therefore, the cartridge auger 124*y* and the conveying paddle 126*y* are rotationally driven by a rotational driving force transmitted from the cartridge motor box MB1*y*. Thus, the toner is conveyed to the toner supply port 123*y*.

As shown in FIG. 9A, a handle member attaching portion 135*y*, to which the handle member 113*y* is attached, is formed at the front end of the toner accommodating container 111*y*.

As shown in FIG. 9A, a contacted member 136*y* is disposed on the bottom wall of the rear end portion of the toner accommodating container 111*y*. When the toner cartridge Ky is attached to the replenishing unit body 1*y*, the toner cartridge Ky is inserted while engaged with and guided by the guide rail 13*y* of the cartridge body support member 12*y*.

Figure 10:
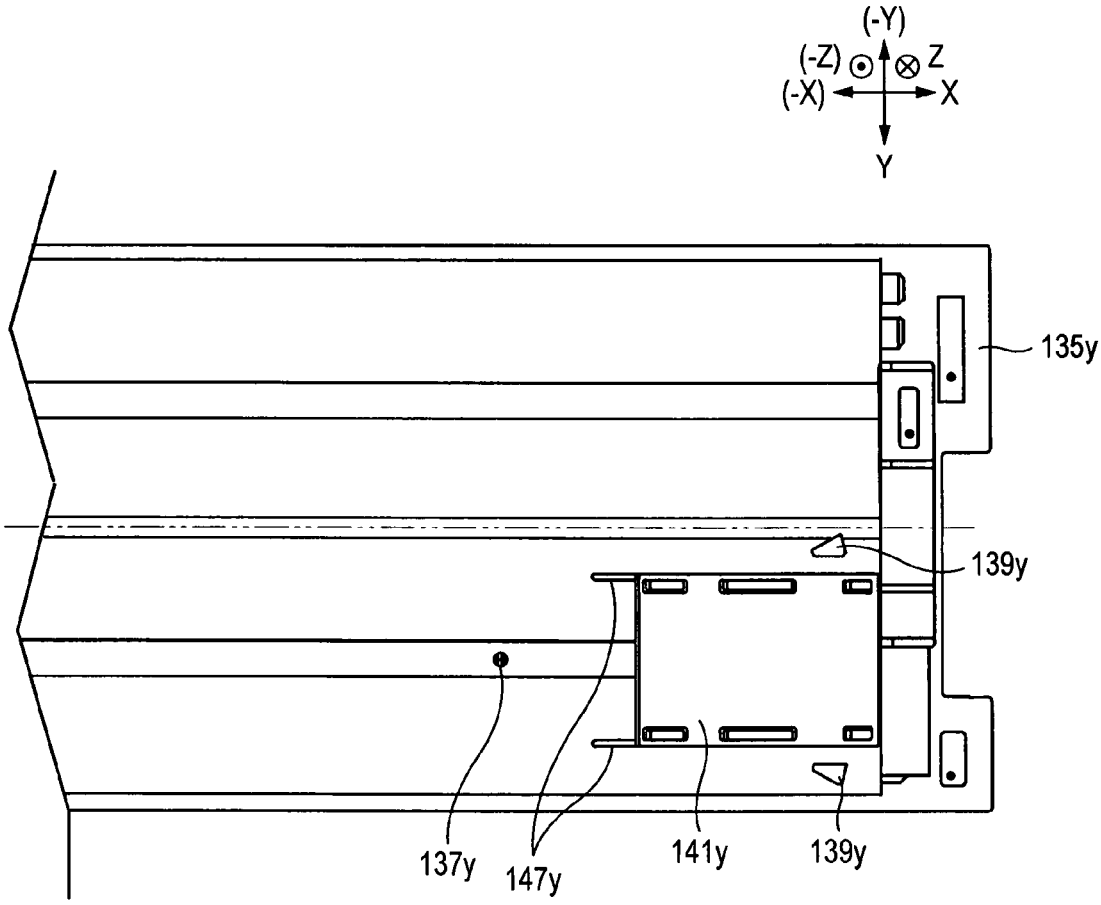
FIG. 10 is an explanatory enlarged view illustrating a front end portion (a rear end portion in a cartridge insertion direction) of a toner accommodating container in a state in which the cartridge shutter is attached thereto.

FIG. 10 is an explanatory enlarged view illustrating the front end portion (the rear end portion in the cartridge insertion direction) of the toner accommodating container in a state in which the cartridge shutter is attached thereto.

As shown in FIGS. 9A, 9B, and 10, a boss (a cartridge-side engagement member, or an engaging projection) 137*y* is formed on the bottom wall of the rear portion of the toner supply port 123*y* to project downwardly (in the (−Z)-direction). The boss 137*y* engages with the replenishing port shutter 33*y* when a user inserts the toner cartridge Ky. Thus, the replenishing port shutter 33*y* is opened and closed in synchronization with an insertion operation and with a drawing operation (see JP-A-2005-134452).

As shown in FIGS. 9A and 9C, the supply port formation member 138*y*, in which the toner supply port 123*y* is formed, is formed at the front end portion of the toner accommodating container 111*y* to protrude downwardly. Shutter guide ribs 138*ay*, 138*ay* (see FIGS. 9C and 9D) supporting the cartridge shutter 141*y* to be able to perform slide-movement are formed at the bottom of the supply port formation member 138*y*.

As shown in FIGS. 9A, 9D, and 10, arm release projection portions 139*y*, 139*y* are formed on both side parts of the rear portion of the toner supply port 123*y* to protrude downwardly. When the toner cartridge Ky is removed (or detached), the arm release projection portions 139*y*, 139*y* engage with the shutter support member 34*y*. Thus, the cartridge shutter 141*y* held by the shutter support member 34*y* is enabled to slide (see JP-A-2005-134452).

Incidentally, the configuration of the cartridge shutter 141*y* and the engagement among the arm release projection portion 139*y*, the boss 137*y*, the shutter support member 34*y*, and the replenishing shutter 33*y* have hitherto been known, as described in JP-A-2005-134452. Thus, the detailed description of the configuration of the cartridge shutter 141*y* and the engagement among the arm release projection portion 139*y* is omitted herein.

Operation of First Embodiment

Next, an operation of the first embodiment is described below. However, the toner replenishing units Hy to Hk respectively corresponding to the colors Y, M, C, and K are configured similarly to one another. Thus, only the toner replenishing unit corresponding to the color Y is described below in detail by adding character "y" to the end of each reference numeral. The detailed description of the toner replenishing units Hm to Hk respectively corresponding to the other colors is omitted herein.

In the image forming unit U having the toner replenishing unit Hy according to the first embodiment, which has the above configuration, toner is replenished from the reserve tank 16*y* to the developing device Gy according to an amount of toner consumed by the developing device Gy when an image is formed. When an amount of the remaining toner in the reserve tank 16*y* is reduced to a small value, toner is replenished from the toner cartridge Ky. When the toner runs out in the toner cartridge Ky, a user is informed of this fact. Then, the user draws out the empty toner cartridge Kk. Subsequently, the user inserts a new toner cartridge Ky to replace the cartridge. Incidentally, the image forming apparatus U according to the first embodiment can continue an image forming operation (or job) using toner accommodated in the reserve tank 16*y*. Thus, the replacement of the toner cartridge Kk can be performed while performing an image forming operation. Especially, two toner cartridges Kk can be attached corresponding to the color K. Thus, the possibility of occurrence of shortage of the developer of the color K, which is frequently used, is reduced. Consequently, the possibility of occurrence of interruption of the image forming operation can be reduced. Accordingly, productivity can be enhanced.

Figures 11A, 11B, 11C:
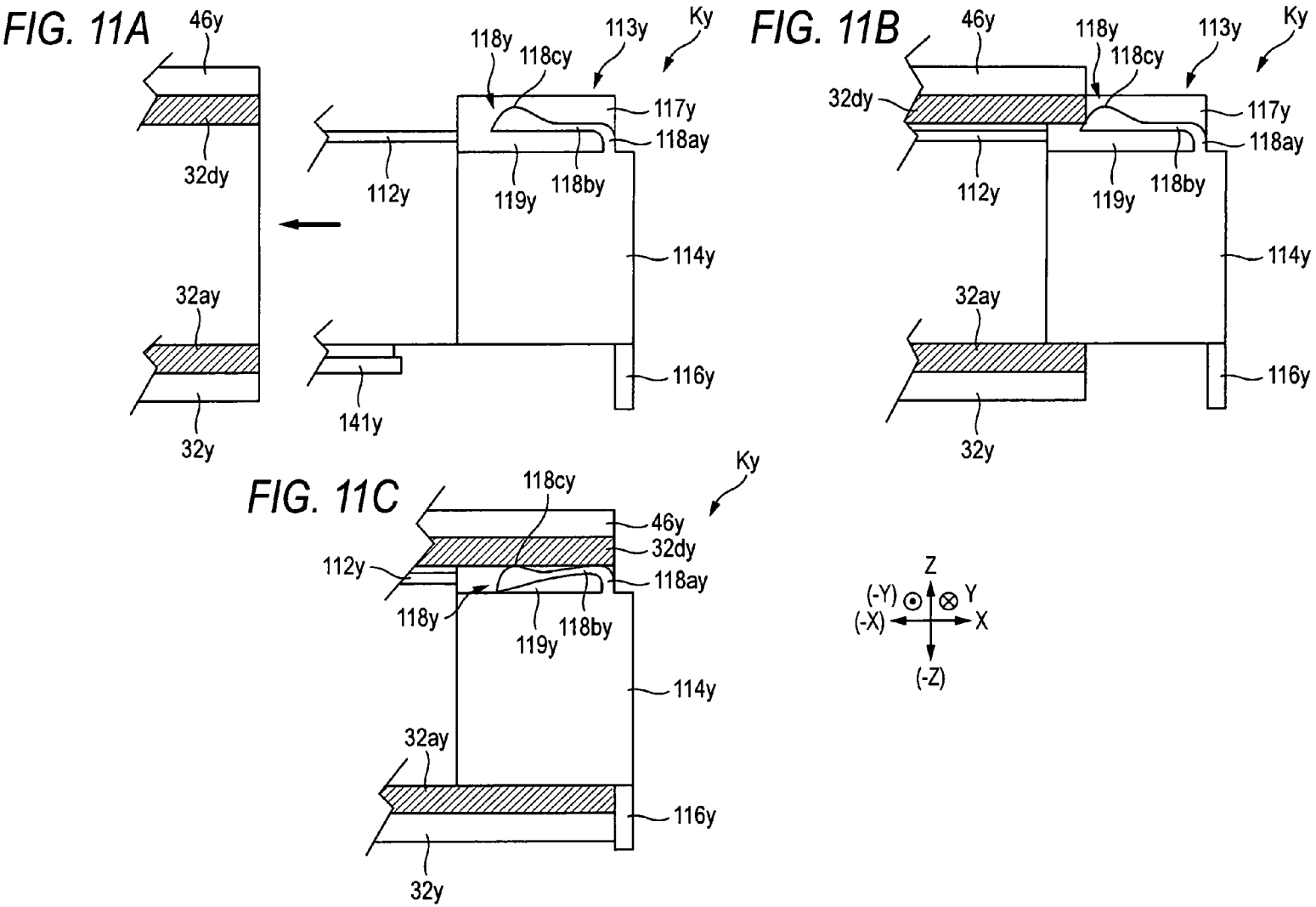
FIGS. 11A to 11C are explanatory views illustrating an operation of the first embodiment.

FIGS. 11A to 11C are explanatory views illustrating an operation of the first embodiment. FIG. 11A is an explanatory view illustrating a state in which the buffer portion is not engaged with an engaged portion therefore yet. FIG. 11B is an explanatory view illustrating a state in which the buffer portion is engaged with the engaged portion therefore. FIG. 11C is an explanatory view illustrating a state in which the attachment of the toner cartridge is completed.

In the image forming apparatus U according to the first embodiment, the replenishing port shutter 33*y* and the cartridge shutter 141*y* can be opened or closed by insertion or detachment of the toner cartridge Ky. As shown in FIGS. 11A to 11C, the guide portion 118*cy* of the buffer portion 118*y* contacts with the top wall portion 32*dy* of the replenishing port formation member 32*y* immediately before the insertion of the toner cartridge Ky is completed (see FIG. 11B). When the toner cartridge is pressed thereinto from this position, an end portion (the end portion at the side of the guide portion 118*cy*) of the buffer portion 118*y* bends (or elastically deforms) downwardly toward the elastic deformation allowable space 119*y*, as shown in FIG. 11C. This generates a force having a component in a direction opposite to a direction in which the toner cartridge Ky is inserted. Therefore, impact, which is caused when the toner cartridge Ky contacts with the replenishing port formation member 32*y* just before the insertion of the toner cartridge Ky is completed, is reduced due to the damper (or cushion) effect by the buffer portion 118*y*.

Especially, the toner cartridge Ky according to the first embodiment is guided along the guide rail 13*y* when starting the insertion thereof. Thus, the toner cartridge inserted in an almost no-load condition. However, the boss 137*y* of the toner cartridge Ky engages with the replenishing port shutter 33*y*. Also, the cartridge shutter 141*y* engages with the shutter support member 34*y*. Thus, when the shutters 33*y* and 141*y* starts to perform slide-movement, a force is needed to move the shutters 33*y* and 141*y*. This force causes a movement resistance to the toner cartridge Ky.

At that time, in a case where a user moves the toner cartridge 141*y* with a large force against the movement resistance with vigor, the stopper portion 116*y* of the toner cartridge Ky collides with the front end surface of the bottom wall portion 32*ay* of the replenishing port formation member 32*y*. Also, the gears G11 and G12 (see FIGS. 8 and 9A) of the toner cartridge Ky collide with the driving force transmitting gear 14*y* of the toner replenishing unit body 1*y*. The image forming unit U vibrates due to impact caused at that time. Accordingly, there is a fear that an adverse influence may be caused on an image during an operation of forming the image.

However, according to the toner cartridge Ky of the first embodiment, the impact can be reduced by the buffer portion 118*y*. Consequently, the adverse influence on the image can be suppressed. Even in a case where an image forming operation is not performed, the possibility of occurrence of displacement and damage of each member due to the impact can be reduced.

Additionally, according to the toner cartridge Ky of the first embodiment, the buffer portion 118*y* is integrally formed using a resin. Thus, the number of components is not large. The impact can be reduced with a low cost configuration. When drawing out the toner cartridge Ky, the original shape of the buffer portion 118*y* is restored by an elastic restoring force. Thus, the buffer portion 118*y* can iteratively be used. Consequently, the running cost thereof can be suppressed.

Also, the toner cartridge Ky according to the first embodiment has the guide portion 118*cy*. Thus, when the toner cartridge Ky is inserted, the buffer portion 118 can surely be bent toward the elastic deformation allowable space 119*y*. A force of buffering impact can surely be caused by the buffer portion 118*y*. Also, the buffer portion 118*y* can be prevented from being damaged by being deformed in an opposite direction.

(Modifications)

Although the embodiment of the invention has been described in detail in the foregoing description, the invention is not limited to the above embodiment. Various modifications may be made within the scope of the invention described in the appended claims. Five examples of the modification of the invention are described below.

FIRST EXAMPLE

Although the copying machine serving as an image forming apparatus has been described in the foregoing description of the embodiment by way of example, the invention is not limited thereto. The invention can be applied to a FAX, a printer, or a complex machine having functions of all of the printer, the FAX, and the copying machine. The image forming apparatus according to the invention is not limited to a color image forming apparatus. The image forming apparatus according to the invention may be implemented as a monochrome image forming apparatus. The image forming apparatus according to the invention is not limited to what is called a tandem type image forming apparatus, the invention can be applied to a rotary type image forming apparatus.

SECOND EXAMPLE

Although it has been described as an example in the foregoing description of the embodiment that the buffer portion is integrally formed using a resin, the buffer portion according to the invention is not limited thereto. For example, the buffer portion may be made of elastic rubber. Alternatively, the buffer portion may be formed of a spring. Preferably, the buffer portion is formed to be able to be repeatedly used, as described in the foregoing description of the embodiment. However, the buffer portion may be configured to be deformed (or destroyed) when once attached. Also, although the buffer portion is provided at the front end portion of the toner cartridge in the above embodiment, the buffer portion may be provided at an optional place.

THIRD EXAMPLE

The configuration of the toner replenishing unit, which includes the replenishing port shutter and the shutter support member, and the configuration of the toner cartridge are not limited to those described in the foregoing description of the embodiment. The invention can employ an optional configuration of a detachable toner cartridge. For example, a configuration (see, for example, JP-A-2003-029518), in which the shutter is opened and closed by rotating the toner cartridge after the toner cartridge is inserted, may be applied to the buffering of impact caused at the insertion, the detachment, and the rotating of the toner cartridge. In addition, the invention can be applied to optional configurations in which the insertion or detachment direction of the cartridge differs from the opening or closing direction of the shutter (see, for example, Patent Document 1).

FOURTH EXAMPLE

Although the embodiment employing the toner cartridge (or developer cartridge) as the detachable cartridge has been exemplified in the foregoing description of the above embodiment, the detachable cartridge according to the invention is not limited thereto. The invention can be applied to an optical detachable cartridge that can be attached to an image forming apparatus body during an image forming operation. For example, the following configurations can be considered, that is, a waste toner cartridge (corresponding to the detachable cartridge) enabled to further collect waste toner collected by a cleaner, a paper tray (corresponding to the detachable cartridge) from which no paper is fed, and a process unit (corresponding to the detachable cartridge) obtained by uniting photoreceptors and developing units corresponding to the colors other than black, which are unused during a monochrome printing operation.

FIFTH EXAMPLE

Although the configuration, in which two toner cartridge accommodating toner of the color K frequently used can be attached to the image forming apparatus body, has been described in the foregoing description of the above embodiment, the configuration of the image forming apparatus according to the invention is not limited thereto. The number of the toner cartridge accommodating toner of the color frequently used can be set to be 1, alternatively, a value that is equal to or more than 3. In this case, the apparatus according to the invention may be configured so that in a case where the detachment of one toner cartridge is detected, toner is replenished from another of the toner cartridges attached thereto.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A detachable cartridge that is detachable from an image forming apparatus body during an image recording operation of recording an image on a recording sheet comprising:

a buffer portion that contacts with a contacted portion when the detachable cartridge is attached to the image forming apparatus body, the contacted portion being provided on the image forming apparatus, and that buffers impact; and a cartridge shutter that is opened and closed in synchronization with an operation of attaching and detaching the detachable cartridge, the buffer portion buffering impact caused when the cartridge shutter is opened and closed.

2. The detachable cartridge as claimed in claim 1, wherein the cartridge shutter and the buffer portion are disposed on a same side in a direction in which the detachable cartridge is attached and detached.

3. The detachable cartridge as claimed in claim 1, comprising a developer cartridge that is attached to and detached from the image forming apparatus, wherein the developer cartridge comprises:

a developer accommodating container that accommodates a developer;

a handle portion that is supported by the developer accommodating container; and the buffer portion that is supported by the handle portion.

4. The detachable cartridge as claimed in claim 3, wherein the buffer portion comprises a body portion and a base portion;

the body portion is connected to the handle portion via the base portion.

5. The detachable cartridge as claimed in claim 4, wherein an elastic deformation allowable space for the buffer portion is defined between the body portion and the handle portion.

6. The detachable cartridge as claimed in claim 3, wherein the buffer portion comprises an elastic material having a property of an elastic deformation.

7. The detachable cartridge as claimed in claim 6, wherein the elastic material comprises a material selected from the group consisting of a resin, an elastic rubber, and a spring.

8. An image forming apparatus comprising a contacted portion to which the detachable cartridge according to claim 1 is attachable, and with which the buffer portion contacts when the detachable cartridge is attached to and detached from the image forming apparatus body.

9. The image forming apparatus as claimed in claim 8, wherein the detachable cartridge comprises a developer cartridge that accommodates a developer of a color frequently used in an image forming operation, the detachable cartridge being attached to the image forming apparatus, the image forming apparatus has a plurality of the developer cartridges, and one of the developer cartridges is capable of being replaced while the other developer cartridges supply a developer to the image forming apparatus.

10. An image forming method comprising:

forming an electrostatic latent image on an electrostatic latent image holding unit; and developing the electrostatic latent image with a plurality of developer to form a toner image, the developers being accommodated in a plurality of developer cartridges, and one of the developer cartridges being replaced while the other developer cartridges supply the developer.

* * * * *